US005659850A

United States Patent [19]

Reeder et al.

[11] Patent Number: 5,659,850

[45] Date of Patent: Aug. 19, 1997

[54] EXCHANGEABLE PHOTORECEPTIVE SHEET AND METHOD AND SYSTEM FOR USING THE SAME

[75] Inventors: Thomas W. Reeder, Arden, N.C.; Ty A. Duval, Atlanta, Ga.

[73] Assignee: Minnesota Mining and Manufacturing Company, St. Paul, Minn.

[21] Appl. No.: 497,365

[22] Filed: Jun. 30, 1995

[51] Int. Cl.[6] ..... G03G 21/00

[52] U.S. Cl. ..... 399/165; 226/96; 399/164

[58] Field of Search ..... 355/212, 211, 355/210; 226/96, 93; 399/165, 164

[56] References Cited

U.S. PATENT DOCUMENTS

| | | | |
|---|---|---|---|
| 3,697,160 | 10/1972 | Clark . | |
| 3,792,924 | 2/1974 | Matsuda et al. . | |
| 3,877,806 | 4/1975 | Schrempp et al. . | |
| 3,926,625 | 12/1975 | van der Sterren . | |
| 3,960,306 | 6/1976 | Hamaguchi | 226/96 |
| 3,984,241 | 10/1976 | Schrempp et al. . | |
| 4,051,986 | 10/1977 | Tiggelers et al. . | |
| 4,057,344 | 11/1977 | Wick et al. . | |
| 4,088,403 | 5/1978 | Kingsley . | |
| 4,155,639 | 5/1979 | Bejerano et al. | 355/212 |
| 4,192,603 | 3/1980 | Buck . | |
| 4,198,155 | 4/1980 | Silverberg . | |
| 4,215,932 | 8/1980 | Castelli et al. . | |
| 4,475,979 | 10/1984 | Idstein et al. . | |
| 4,728,983 | 3/1988 | Zwadlo et al. . | |
| 4,758,486 | 7/1988 | Yamazaki et al. | 355/212 |
| 5,119,133 | 6/1992 | Swain . | |
| 5,267,001 | 11/1993 | Kanai et al. . | |
| 5,357,318 | 10/1994 | Haneda et al. . | |
| 5,420,670 | 5/1995 | Fukuoka et al. . | |

FOREIGN PATENT DOCUMENTS

| | | |
|---|---|---|
| 60-195580 | 10/1985 | Japan . |

*Primary Examiner*—R. L. Moses
*Attorney, Agent, or Firm*—William K. Weimer

[57] ABSTRACT

A photoreceptive sheet within an imaging apparatus is repeatedly transportable through a transport path and capable of capturing and transferring images. In addition, the photoreceptive sheet is repeatedly transportable for capturing and transferring a number of images. A transport path of the photoreceptive sheet can be a transport loop having a loop distance which can be greater than the length of the photoreceptive sheet. Excess ink or toner can be removed from the photoreceptive sheet by directing the excess to the resulting gap between a first end and the second end of the photoreceptive sheet and into a container.

53 Claims, 7 Drawing Sheets

EXCHANGEABLE PHOTORECEPTIVE SHEET AND METHOD AND SYSTEM FOR USING THE SAME

FIELD OF THE INVENTION

The present invention is directed generally to an apparatus and method for electrophotographic printing. In particular, the present invention is directed to an apparatus and method for electrophotographic printing using an easily exchangeable photoreceptive sheet.

BACKGROUND OF THE INVENTION

An electrophotographic apparatus includes several systems, including a latent image-forming system, which applies a uniform potential to a photoreceptive material. The latent image-forming system then applies light to the photoreceptive material in an image-wise pattern to create a latent image corresponding to an image held within the electrophotographic apparatus or some other image source. The image held by the electrophotographic apparatus can be acquired, for example, from an original document or copy sheet, or from desktop publishing computer software.

A toner deposition system within the electrophotographic apparatus applies a conductive, solid or liquid toner to the photoreceptive material which collects on photoreceptive material in a pattern similar to image-wise pattern. A transfer system transfers the inked image from the photoreceptive material either directly onto a final substrate, such as a sheet of paper, or onto an intermediate substrate before being subsequently transferred to the final substrate.

A first transport mechanism transports the photoreceptive material within the electrophotographic apparatus and through the previously mentioned systems. In addition, a second transport mechanism transports the input sheet to and from the toner transfer mechanism.

Commonly, the photoreceptive material is a material which is coated onto a drum or belt, depending on the type of electrophotographic apparatus. After numerous passes within the electrophotographic apparatus, the photoreceptive material can require replacement. When the photoreceptive material is coated onto the drum, replacing the photoreceptive material requires replacing the entire drum, which can be costly and difficult to accomplish.

When the photoreceptive material is coated onto a belt, replacement cost is reduced in comparison. However, removing the spent belt and replacing it with a new belt requires disassembly of the belt transport mechanism, which is difficult and time-consuming. If, however, the belt transport mechanism is made using cantilevered rollers, disassembly is simplified. But, a cantilevered belt transport mechanism is more complex and requires significant structural support within the electrophotographic apparatus to provide a sufficiently stable transport path for the belt. Such support adds cost, size, and weight to the electrophotographic apparatus.

In addition, a belt inherently includes a seam. Seams are often made by thermally fusing the two ends of a web together. This, of course, limits the type of material of which the belt may be constructed, namely, thermally fusible material. Plus, because seaming creates irregularities in the photoreceptive material along the seam, the quality of the image can be adversely affected when the image is imposed across the seam.

U.S. Pat. No. 4,088,403 (inventor: Kingsley) discloses coating the photoreceptive material onto a length of carrier material to create a photoconductive belt. The belt must be stretched around a sub-belt so that the photoconductive belt is under tension and so that the ends of the belt are brought together or overlap each other to form a joined belt. The leading and trailing edges are either adhered to the sub-belt or are attached to each other with means such as adhesive or a hook-and-loop fastener. With this construction, the photoconductive belt can be wrinkled or excessively stretched as it is transported with the sub-belt. In addition, this photoconductive belt is not easily removed and replaced with a new belt within the apparatus in which it functions, such as an electrophotographic apparatus.

SUMMARY OF THE INVENTION

The present invention overcomes these problems by providing an apparatus adapted for use within an electrophotographic apparatus. This apparatus include radiation means for directing an image-wise pattern of radiation. A photoreceptive sheet is positioned relative to the radiation means such that the photoreceptive sheet can capture an image corresponding to the image-wise pattern. The photoreceptive sheet has a first end and a second end. A sheet-transporting mechanism can repeatedly transport the photoreceptive sheet through a transport path.

Another embodiment of the present invention is a photoreceptor adapted for use within an electrophotographic apparatus having a transporting mechanism for transporting the photoreceptor through a transport path, the photoreceptor. The photoreceptor is a sheet having a first end, a second end, at least one side edge, and a photoreceptive means disposed between the first and second ends.

Another embodiment of the present invention includes a method for transporting a photoreceptor within an electrophotographic apparatus. One step is providing a photoreceptive sheet. Another step is providing a transporting component moveable through a transport path. Another step is functionally connecting the photoreceptive sheet to the transporting component. Still another step is moving the transporting component to transport the photoreceptive sheet through the transport path.

Another embodiment of the present invention is a method for introducing a photoreceptive sheet to and removing the photoreceptive sheet from a transporting mechanism within an electrophotographic apparatus. The photoreceptive sheet has a first end and a second end. The transport mechanism can transport the photoreceptive sheet in a loop. The method includes the step of providing a transporting component within the transport mechanism. Another step includes directing the photoreceptive sheet to the transporting component. Another step includes fastening the photoreceptive sheet to the transporting component so that the transporting component transports the photoreceptive sheet around the transport loop. Another step includes providing a sheet-directing component. Still another step includes inserting the sheet-directing component between the first end and the second end while the photoreceptive sheet is transported around the transport loop to unfasten the photoreceptive sheet from the transporting component and to direct the photoreceptive sheet from the transporting component.

Another embodiment of the present invention is a method for fastening a photoreceptive sheet to a transporting component within an electrophotographic apparatus. The photoreceptive sheet has a first end and a second end and is transportable by the transporting component around a transport loop. The method includes the step of positioning the photoreceptive sheet adjacent to the transporting component. Another step includes introducing the photoreceptive sheet to the transporting component such that a gap exists being the first end and the second end when the photoreceptive sheet is transported around the transport loop. Still another step includes pressing the photoreceptive sheet and the transporting component together.

Another embodiment of the present invention includes a method for fastening a photoreceptive sheet to a transporting component within an electrophotographic apparatus. The transporting component has a first center plane and the photoreceptive sheet has a second center plane. The method includes the step of positioning the photoreceptive sheet relative to the transporting component so that the first and second center planes are substantially aligned. Another step includes fastening the photoreceptive sheet to the transporting component.

Still another embodiment of the present invention is an electrophotographic apparatus which includes an apparatus housing. Radiation means within the apparatus housing directs an image-wise pattern of radiation. A sheet-transporting mechanism is positioned within the housing. A photoreceptive sheet is positionable within the housing and configured to be transportable through a sheet path by the sheet-transporting mechanism and capable of capturing an image corresponding to image-wise pattern.

BRIEF DESCRIPTION OF THE DRAWINGS

The foregoing advantages, construction, and operation of the present invention will become more readily apparent from the following description and accompanying drawings in which.

DETAILED DESCRIPTION OF PREFERRED EMBODIMENTS

Figure 1:
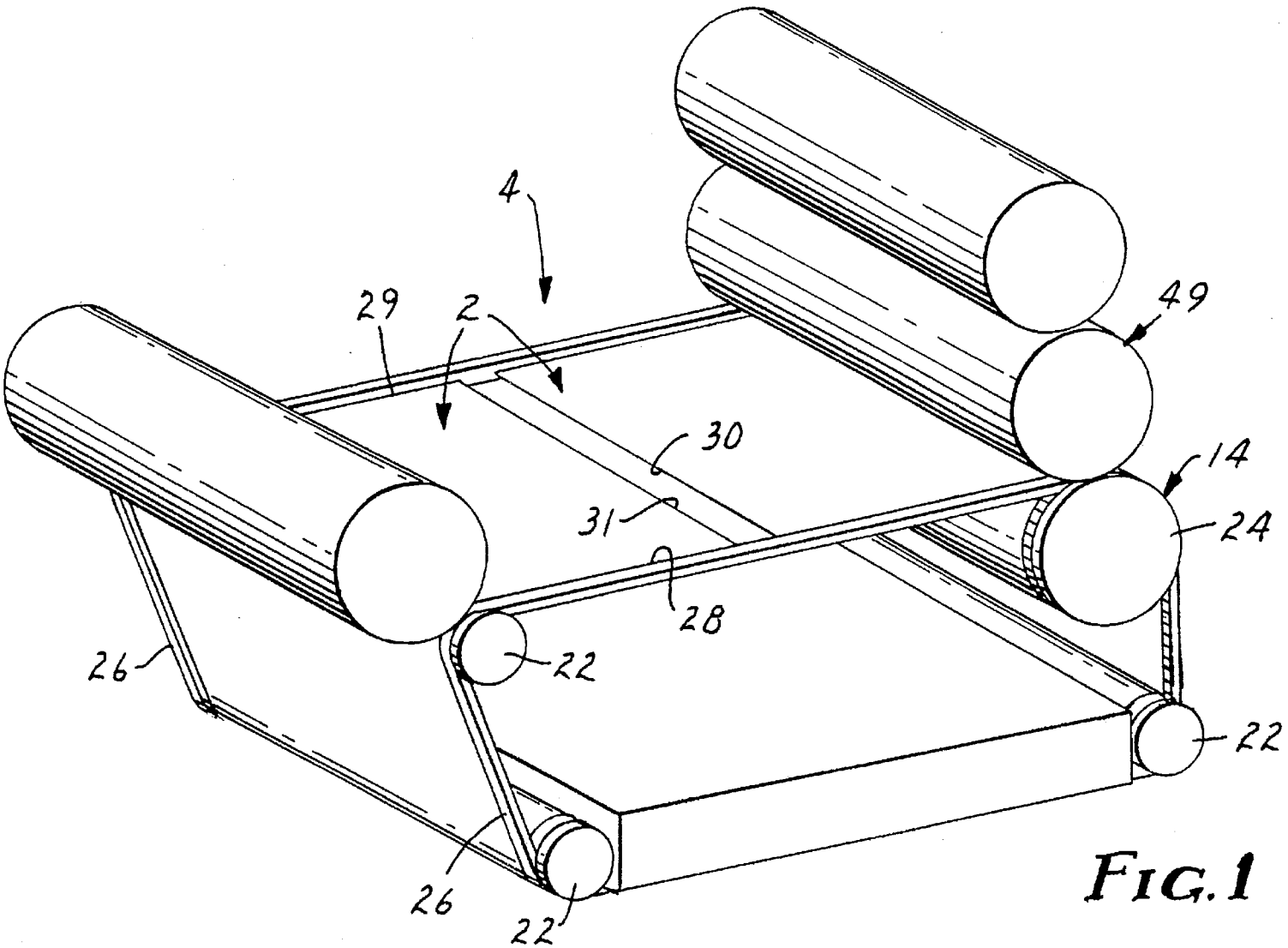
FIG. 1 is a perspective view of a photoreceptive sheet fastened to a transport mechanism within an electrophotographic apparatus.
Figure 2:
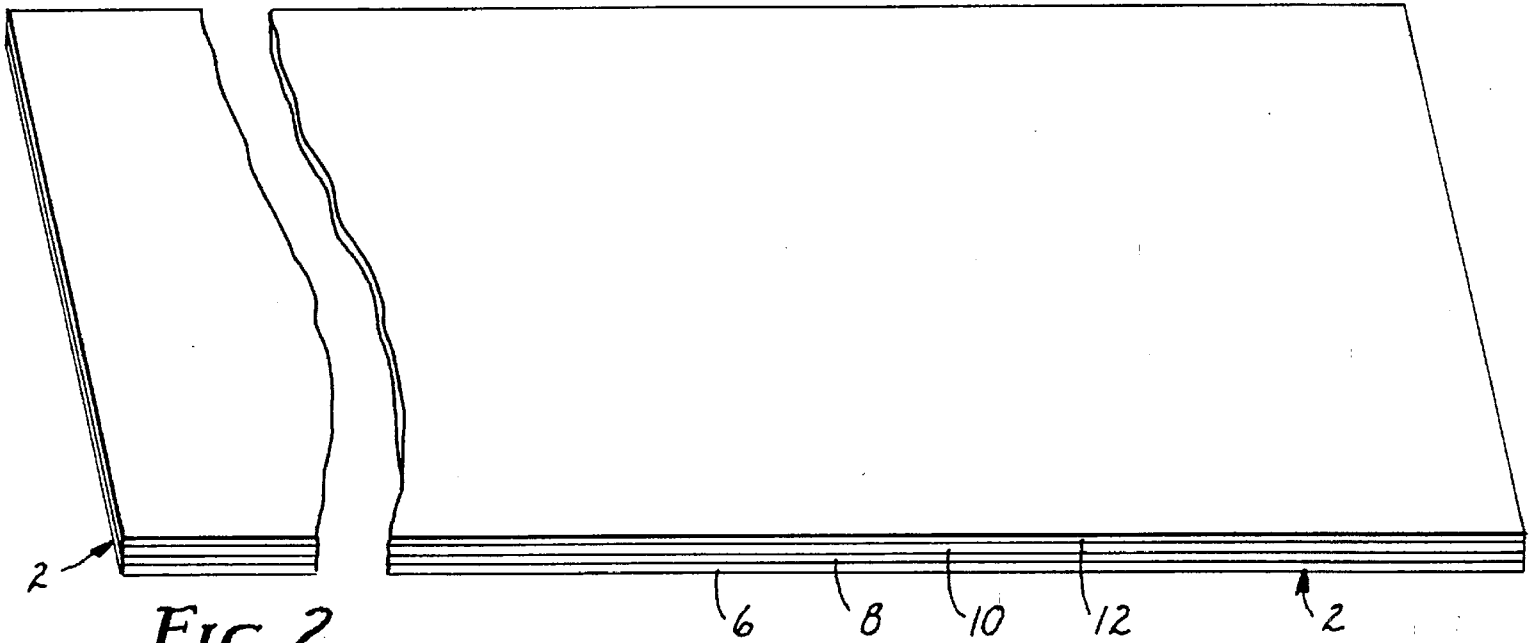
FIG. 2 is a partial perspective schematic view of one embodiment of the photoreceptive sheet.

A photoreceptor, shown as a photoreceptive sheet in FIG. 1, is adapted for use within an electrophotographic apparatus 4. The photoreceptive sheet 2 can be adapted for repeated use within the electrophotographic apparatus 4. One embodiment of the photoreceptive sheet 2 can be made of the same materials used to make known photoreceptive belts. A specific embodiment of the photoreceptive sheet 2 is shown in FIG. 2 as being a multi-layer sheet. The multi-layers include a base sheet 6, a photoreceptive layer 8, a barrier layer 10, and a release layer 12. The base sheet 6 can be, for example, a polyester film and have a 0.004 inch (0.010 centimeter) thickness. The base sheet 6 could instead be a polyamide film or a metal-coated film, such as an Aluminum vapor-coated polyester film (1% light transmissive vapor coating). The photoreceptive layer 8 can be approximately 15 microns thick and include materials such as azo pigments, molecular complexes, perylene pigments, phthalocyanine pigments, squaraine pigments, or other known materials. The photoreceptive layer 8 can be applied by die-coating these photoreceptive materials onto the base sheet 6. The barrier layer 10 can be approximately 0.2 microns thick and made of materials such polyvinylbutyrl resin. The barrier layer 10 can be applied by die-coating the polyvinylbutyrl resin onto the photoreceptive layer 8. The release layer 12 can be made of a silicone and have a thickness of approximately 0.65 microns. The release layer can be applied by die-coating the silicone onto the barrier layer 10.

Unlike a photoreceptive belt, the photoreceptive sheet 2 need not be seamed to function properly. Consequently, the material choices are not limited to seamable material, such as a thermally fusible material.

The photoreceptive sheet 2 can be repeatedly transported through a transport loop within the electrophotographic apparatus 4 by a first transport mechanism 14. The transport loop can have, for example, a rectangular shape, a circular shape, or another shape. The transport loop can have a transport loop distance, that is, the distance around the transport loop. The first transport mechanism 14 can include multiple idler rollers 22, a drive roller 24, and at least one transporting component.

Figure 3:
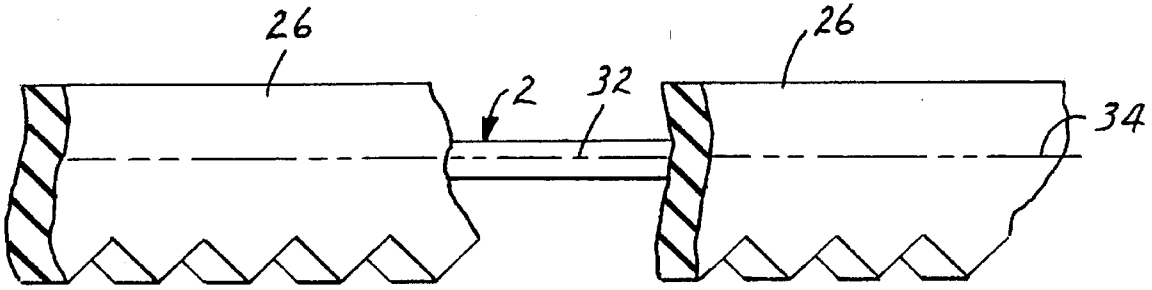
FIG. 3 is a partial perspective view of the photoreceptive sheet shown in FIG. 2 aligned with and fastened to a timing belt.

The transporting component can be a belt 26, although other transporting components could be used. As shown in FIG. 3, the belt can be an edge belt, such as a timing belt. With an edge belt, a substantial portion of the photoreceptive sheet 2 is not supported by another component, such as a full-width belt (not shown).

Two belts 26 can form the transport loop by riding over the idler rollers 22 and the drive roller 24. The drive roller 24 can mate with and drive the belts 26. The belts 26 can be fastenable to, or in some other way functionally coupleable to, the side edges 28, 29 of the photoreceptive sheet 2 to transport photoreceptive sheet 2 through the transport loop.

The transporting component could be designed to be fastenable to at least a portion of leading edge 30 of the photoreceptive sheet rather than, or in addition to, the side edges 28, 29. Similarly, the transporting component could be designed to also be fastenable to the trailing edge 31 of the photoreceptive sheet 2.

To minimize wrinkling the photoreceptive sheet 2 during transport, the center plane 32 of the photoreceptive sheet 2 should be aligned with the center plane 34 of each of the belts 26, as shown in FIG. 3. To accomplish this alignment, each belt 26 can be fastenable to the photoreceptive sheet 2 using one of the fastening webs 36A, 36B as shown in FIGS. 4 and 5.

Figure 4:
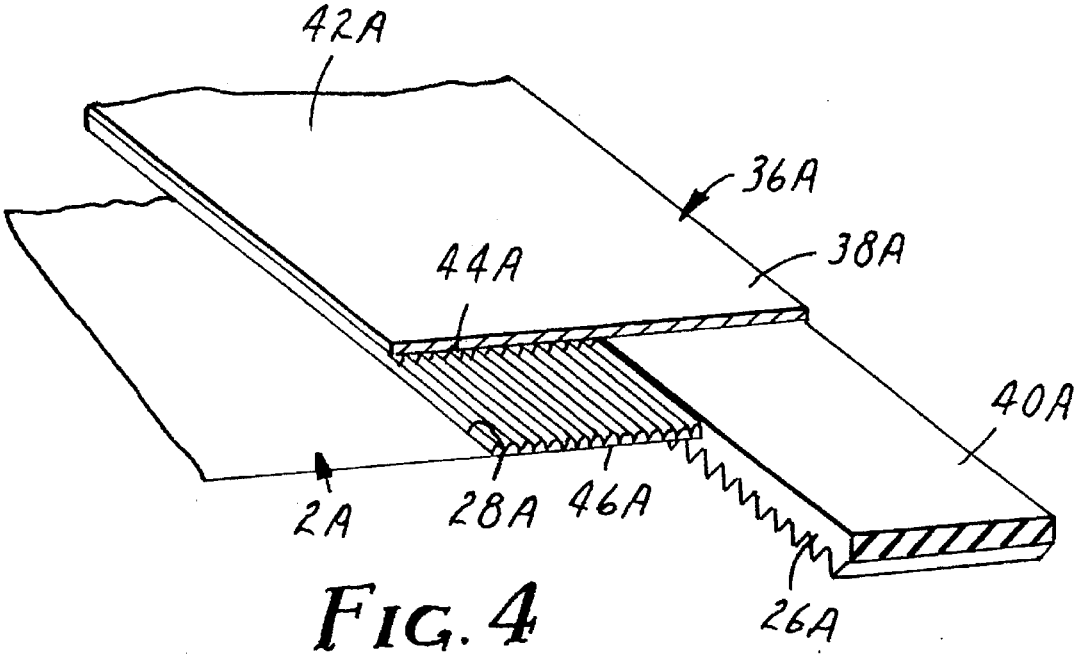
FIG. 4 is a partial perspective view of the attachment of the photoreceptive sheet to the timing belt shown in FIG. 3.

As shown in FIG. 4, a first portion 38A of the fastening web 36A can be connected to the top surface 40A of one of the belts 26A. A second portion 42A of the fastening web 36A extends from beyond the belt 26A and includes a fastening surface 44A which can be repeatedly fastened to and unfastened from a fastening surface 46A near one of the side edges 28A (29A not shown) and on the top surface 47A of the photoreceptive sheet 2A. Using this fastening web 36A, the photoreceptive sheet 2A can be delivered to the belts 26A from below the belts 26A.

Figure 5:
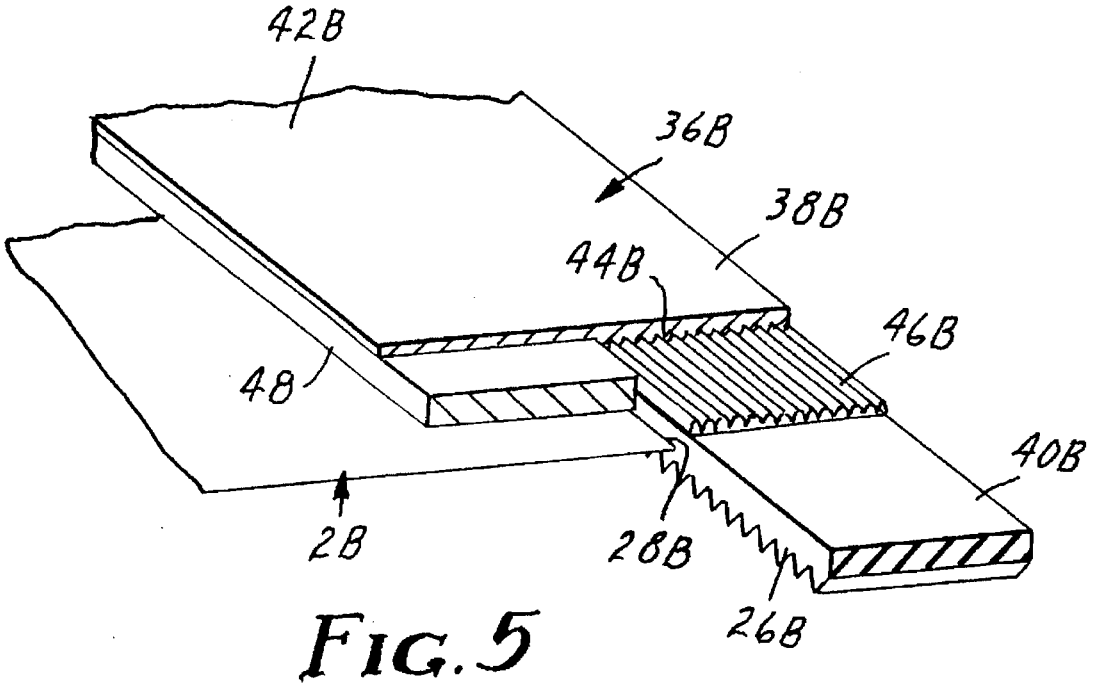
FIG. 5 is a partial perspective view of another embodiment of the attachment shown in FIG. 4.

As shown in FIG. 5, an alternative embodiment of the fastening web 36B can be used in place of the previously described fastening web 36A. A fastening surface 44B on the first portion 38B of the fastening web 36B can be fastened to, unfastened from, and refastened to a fastening surface 46B located on the top surface 40B of the belt 26B. The second portion 42B of the fastening web 36B can be connected to the photoreceptive sheet 2B. To properly align the center plane 32 of the photoreceptive sheet 2B and the center plane 34 of the belts 26B, a spacer 48 can be used between the photoreceptive sheet 2B and the second portion 42B of the fastening web 36B. The refastenability of the fastening surfaces 44B, 46B allow for removal and replacement of the photoreceptive sheet 2B and fastening web 36B from the belts 26B. Using this fastening web 36B, the photoreceptive sheet 2B can be delivered to the belts 26A from above the belts 26A.

The refastenable fastening surfaces 44A, 46A can be microstructured surfaces, adhesive-based surfaces, or some other similarly performing surfaces. An example of an adhesive-based surface could be an adhesive tape which loses adhesion when stretched. This type of tape can be referred to as "stretch-and-release" tape.

The refastenable fastening surfaces 44A, 46A can be formed as part of the photoreceptive sheet 2A or the fastening web 46A, or can be a separate component connected to photoreceptive sheet 2A or the fastening web 46A.

The refastenable fastening surfaces 44A, 46A can be constructed so that when joined, the center plane 32 of the photoreceptive sheet 2A and the center plane 34 of each of the belts 26A are properly aligned. The refastenability of the fastening surfaces 44A, 46A allow for removal and replacement of the photoreceptive sheet 2A from the belts 26A and fastening web 36A. To firmly fasten the refastenable fastening surfaces 44, 46 to the belts 26, the photoreceptive sheet 2 and the belts can be driven between a pair of nip rollers, such as drive roller 24 and top roller 49.

Although the first portion 42A and the second portion 42B of the fastening web 36A, 36B, respectively, were previously referred to as being "connected" to the top surface 40A of the belt 26A and to spacer 48, respectively, the connection need not be permanent. The connection of these components is sufficiently secure if more secure than the fastening of the refastenable fastening surfaces 44, 46.

The length of the photoreceptive sheet 2 can be chosen so that when the photoreceptive sheet 2 is fastened to the belts 26, the leading edge 30 of the photoreceptive sheet 2 does not reach around the transport loop to meet the trailing edge 31 of the photoreceptive sheet 2. This creates a gap 52 between the trailing edge 30 and leading edge 31. Alternatively, the length of the photoreceptive sheet 2 can be chosen so that the leading edge 30 either abuts or overlaps the trailing edge 31. In this case, a gap 52 can be avoided, if desired. Preferably, the photoreceptive sheet 2 is not stretched when fastened to the belts 26.

Figure 6:
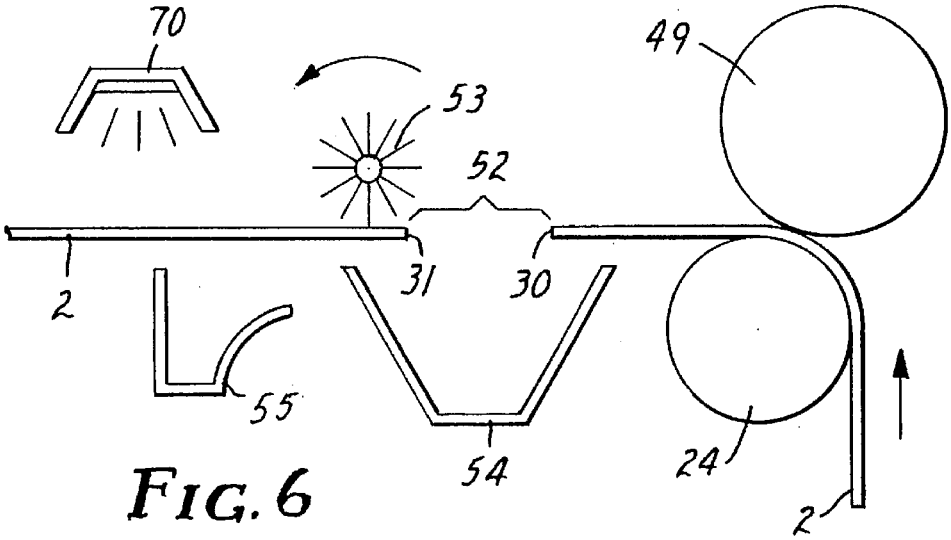
FIG. 6 is a partial side schematic view of the photoreceptive sheet shown in FIG. 2, a sheet-directing mechanism, a brush, and a container.

The gap 52 between the leading and trailing edged 30, 31 can provide numerous advantageous. First, because the photoreceptive sheet 2 is made of materials the cost of which are not insignificant, minimizing the length of photoreceptive sheet 2 is cost-effective. Second, when an amount of ink remains on the photoreceptive sheet 2 after the bulk of the ink is transferred from the photoreceptive sheet to another substrate (such as a sheet of paper), a sheet brush 53 can be included within the electrophotographic apparatus 4 to brush the excess ink to the gap 52 and into a container 54, as shown in FIG. 6. The brush 53 could be, for example, stationary or rotating. Or, the brush 53 could be replaced by a stationary blade (not shown), or another means for removing the remaining ink.

Third, the gap 52 allows for a sheet directing mechanism 55 within the electrophotographic apparatus 4 to, for example, contact the leading edge 30 and remove the photoreceptive sheet 2 from the transport mechanism 14. This sheet-directing mechanism 55 could direct the photoreceptive sheet 2 into a sheet container 56, shown in FIG. 6.

The size of the gap 52 can be chosen to provide one or more of the previously noted advantages. The gap 52 can be, for example, two centimeters or greater. To create the gap 52, the length of the photoreceptive sheet 2 can be, for example, 98% of the length of the belts 26, or less.

Rather than using the previously described sheet-transporting mechanism, the photoreceptive sheet 2 can be transported by being attached to (and removable from) a rotating drum (not shown). The size of the sheet 2 and the drum can be chosen to create a gap between the ends of the photoreceptive sheet 2. The other previously described features could be modified to function with a rotating drum rather than the edge belts 26.

Figure 7:
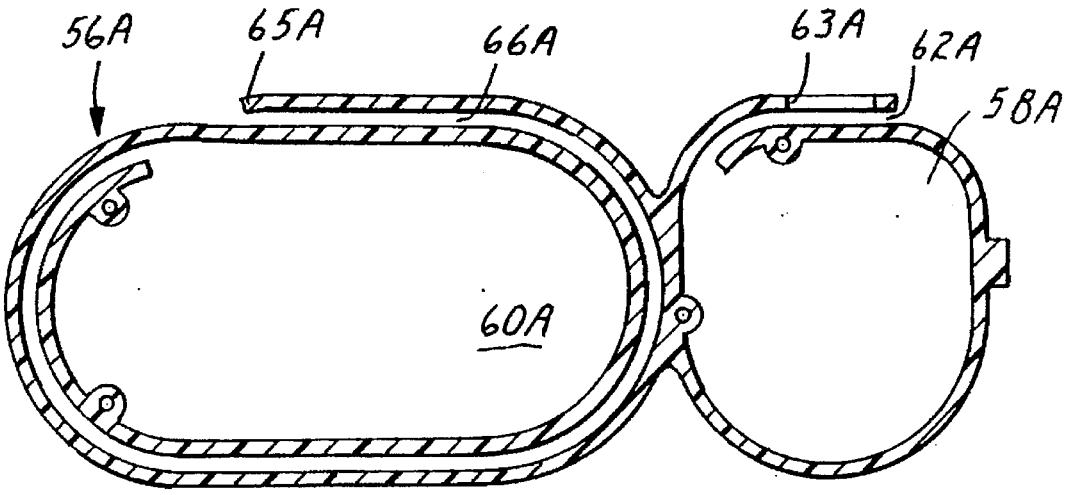
FIG. 7 is a side sectional view of a sheet cartridge containing the photoreceptive sheet of FIG. 2.
Figure 8:
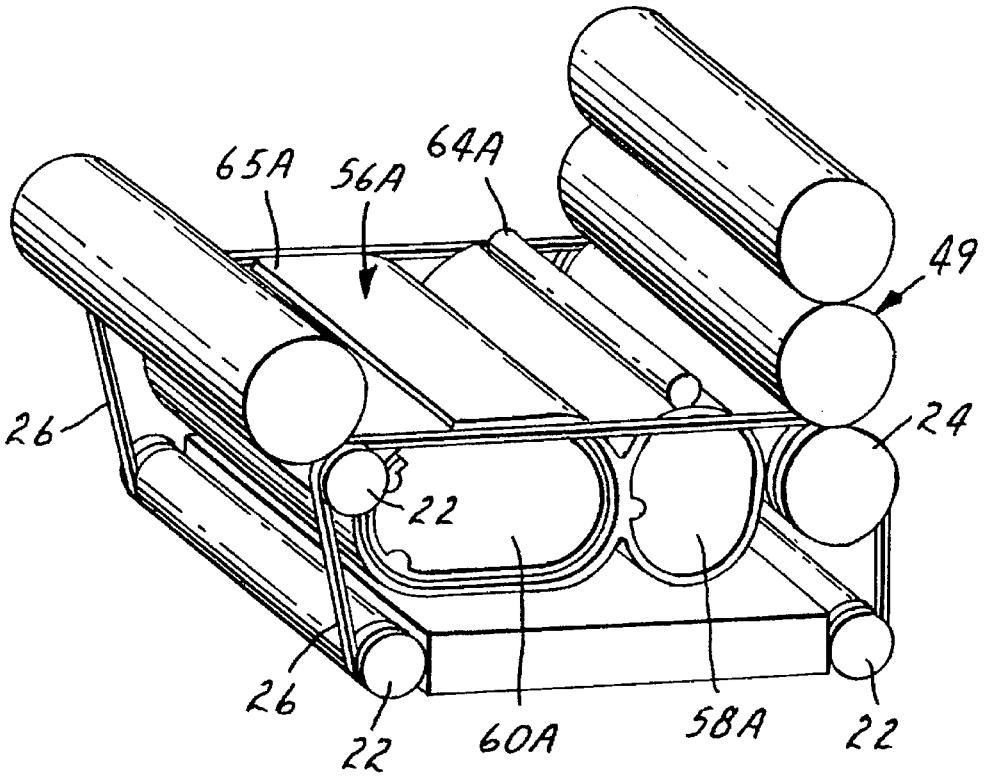
FIG. 8 is a perspective view of the sheet cartridge shown in FIG. 7 positioned within a transport mechanism of an electrophotographic apparatus.

The photoreceptive sheet 2 can be delivered to the first transport mechanism 14 from the sheet cartridge 56. The sheet cartridge 56 can be an injection-molded article being moldable from a variety of injection-moldable resins. As shown in FIGS. 7 and 8, one embodiment of the sheet cartridge 56A can be constructed to work in conjunction with the orientation of the photoreceptive sheet 2A, belts 26A, and fastening web 36A shown in FIG. 4. As shown in FIG. 8, the sheet cartridge 56A can include a housing 57A which defines a first chamber 58A for storing and allowing the dispensing of a new photoreceptive sheet 2A, and defining a second chamber 60A for receiving and storing an expended photoreceptive sheet 2A.

The cartridge can include an outlet 62A which functionally communicates with the first chamber 58A and the electrophotographic apparatus 4A. In other words, the new photoreceptive sheet 2A can move from the first chamber 58A to the electrophotographic apparatus 4A.

As shown in FIG. 8, the sheet cartridge 56A is positionable within the zone created by the belts 26A so that the photoreceptive sheet 2A can be properly presented and fastened to the belts 26A. When the sheet cartridge 56A is inserted and the electrophotographic apparatus 4A is actuated, the portion of the new photoreceptive sheet 2A which extends from the first chamber 58A can be driven out of the first chamber 58A and to the belts 26A. The outlet 62A can include a slot roller groove 63A through which a sheet driving roller 64A can fit to drive the new photoreceptive sheet 2A from the first chamber 56A. After the photoreceptive sheet 2A is dispensed, the sheet cartridge 56A can be removed from the electrophotographic apparatus 4A.

After some number of uses, the photoreceptive sheet 2A can become expended, or the user may simply want to replace it. The electrophotographic apparatus 4 can include a directing member 65A to direct the expended photoreceptive sheet 2A through an inlet 66A and into the second chamber 60A. A new photoreceptive sheet 2A can be immediately or simultaneously dispensed from the first chamber 58A in the new sheet cartridge 56A. The directing member 65A can be, for example, operated manually by a user or automatically by a mechanism (not shown) within the electrophotographic apparatus 4A. The directing member 65A within the sheet cartridge 56A could replace the previously described sheet directing mechanism 55 or could work in conjunction with the sheet directing mechanism 55.

The first chamber 58A and the second chamber 60A can each be of a size to house more than a single photoreceptive sheet 2. Therefore, when a sheet 2A becomes expended, the sheet 2A could be directed into the second chamber 60A and a new sheet 2A can be withdrawn from the first chamber 58A.

Because the photoreceptive sheet 2A can be in sheet-form when inserted, used, and removed from the transport system 14, the new and the expended sheets 2A can be curved or even rolled up within the first chamber 58A and the second chamber 60A, respectively. A rolled photoreceptive sheet 2A takes up far less space than a folded, uncreased photoreceptive belt. Consequently, the sheet 2A allows the sheet cartridge 56 to be an efficient storage and delivery means for the electrophotographic apparatus 4A.

The cartridge 56 can be shaped such that the photoreceptive sheet 2A is stored in a flat form within the first chamber 58A and/or second chamber 60A, rather than being in a curved form. This could be advantageous for a construction of the photoreceptive sheet which is better preserved when stored in a flat form. For example, one construction of a photoreceptive sheet stored in, for example, a rolled form for a long period of time may be less easily transported than one stored for a long period of time in a flat form. This advantage may be particularly important for storing a plurality of photoreceptive sheets in a flat form.

In addition to storage advantages, the photoreceptive sheet 2A can more easily be inserted into and removed from the transport system 14A than a photoreceptive belt. Being inserted from the sheet cartridge 56, as previously noted, does not require the removal of roller supports, unlike when a belt is inserted. Plus, inserting and removing a sheet 2A from the transport system 14 do not require the use of heavy-duty, cantilevered rollers.

Figure 9:
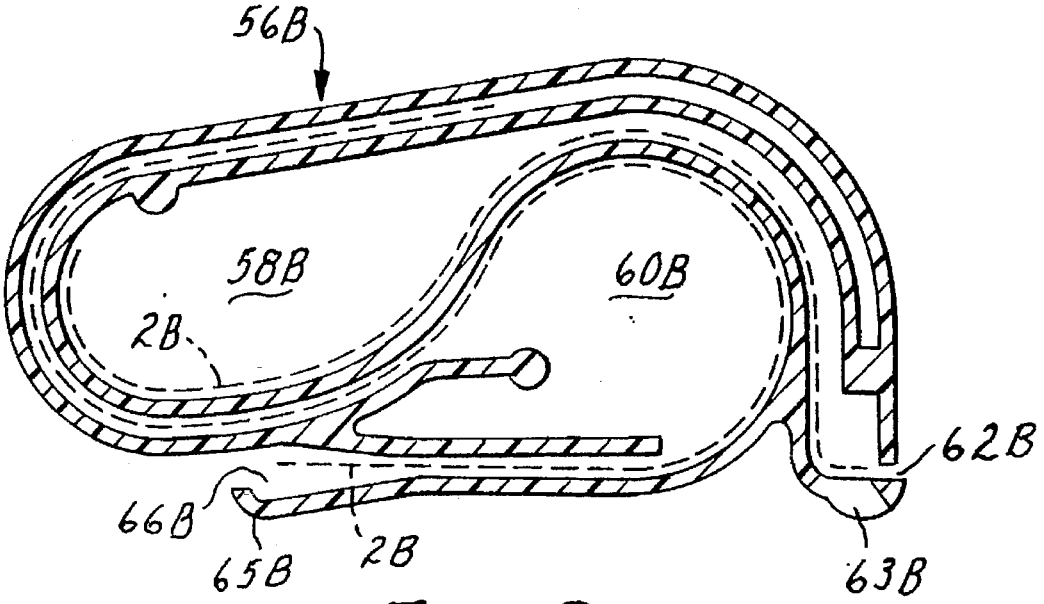
FIG. 9 is a side sectional view of another embodiment of the sheet cartridge shown in FIG. 7.
Figure 10:
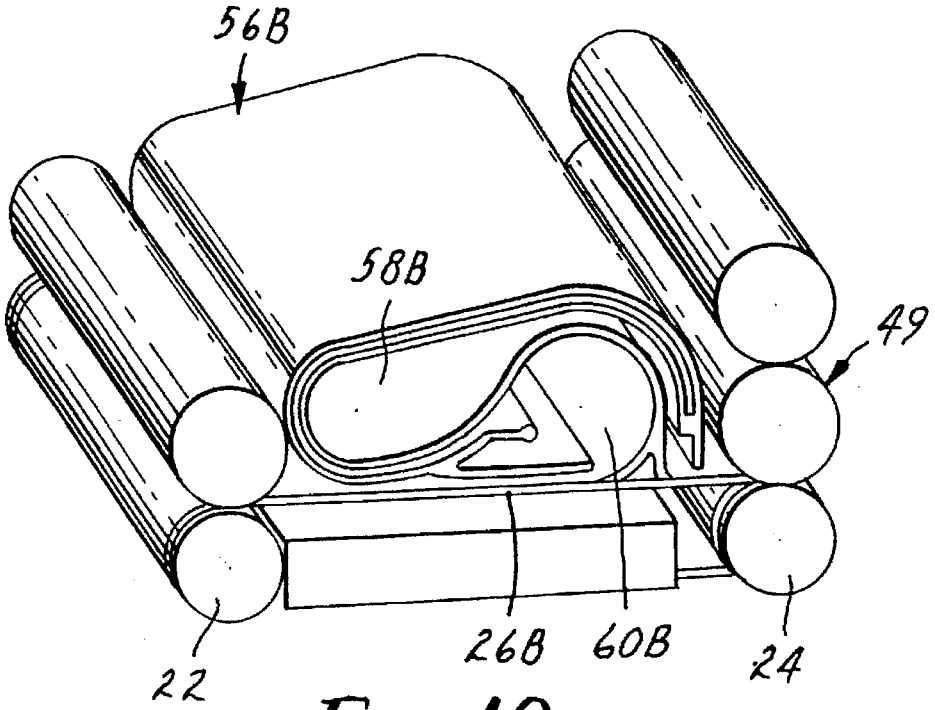
FIG. 10 is a perspective view of the sheet cartridge shown in FIG. 9 positioned within the transport mechanism of an electrophotographic apparatus.

A second embodiment of the sheet cartridge 56B is shown in FIGS. 9 and 10. This sheet cartridge 56B can be constructed to work in conjunction with the orientation of the photoreceptive sheet 2B, belts 26B, and fastening web 36B shown in FIG. 5. As shown in 9, the sheet cartridge 56B can include a housing 57B which defines a first chamber 58B for storing and dispensing a new photoreceptive sheet 2B and which defines a second chamber 60B for receiving and storing an expended photoreceptive sheet 2B.

As shown in FIG. 10, the sheet cartridge 56B is positionable above the zone created by the belts 26B so that the photoreceptive sheet 2B can be properly presented and fastened to the belts 26B. When the sheet cartridge 56B is inserted and the electrophotographic apparatus 4 begins to operate, the portion of the new photoreceptive sheet 2B which extends from the first chamber 58B can be driven out of the first chamber 58B and onto the belts 26B by a sheet-driving roller 64B. The sheet-driving roller 64B fits within a roller groove 63B of the sheet cartridge 56B.

Figure 11:
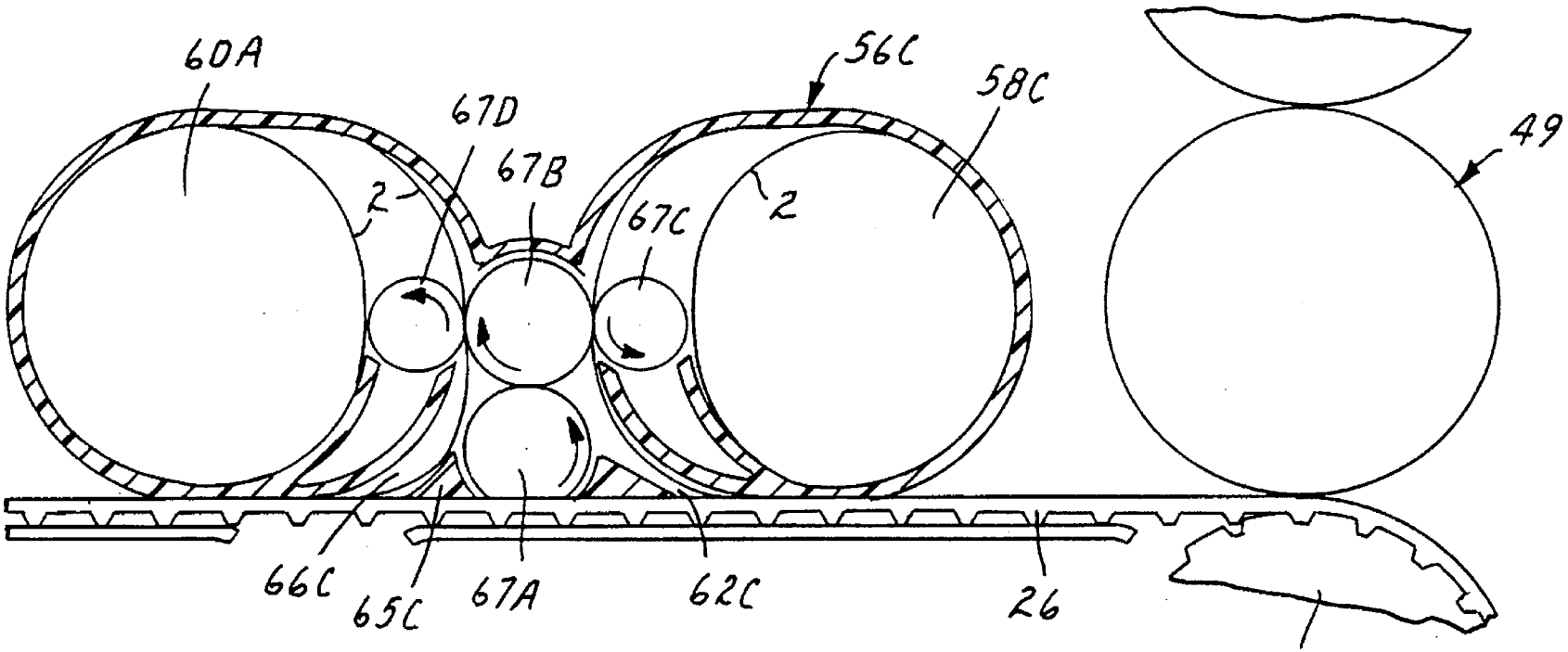
FIG. 11 is a side sectional schematic view of another embodiment of the sheet cartridge from which a new photoreceptive sheet is being dispensed and by which an expended photoreceptive sheet is being received.

A third embodiment of sheet cartridge 56C is shown in FIG. 11 as including internal sheet-driving rollers 67. The lower internal sheet-driving roller 67A can ride on and be driven by the belts 26. The lower internal sheet-driving roller 67A can, in turn, drive three other internal sheet-driving rollers 67B, 67C, 67D. Internal sheet-driving rollers 67B, 67C can feed out a new photoreceptive sheet 2 from the sheet cartridge 56C, while internal sheet-driving roller 67B, 67D can draw an expended photoreceptive sheet into the sheet cartridge 56C.

Figure 12:
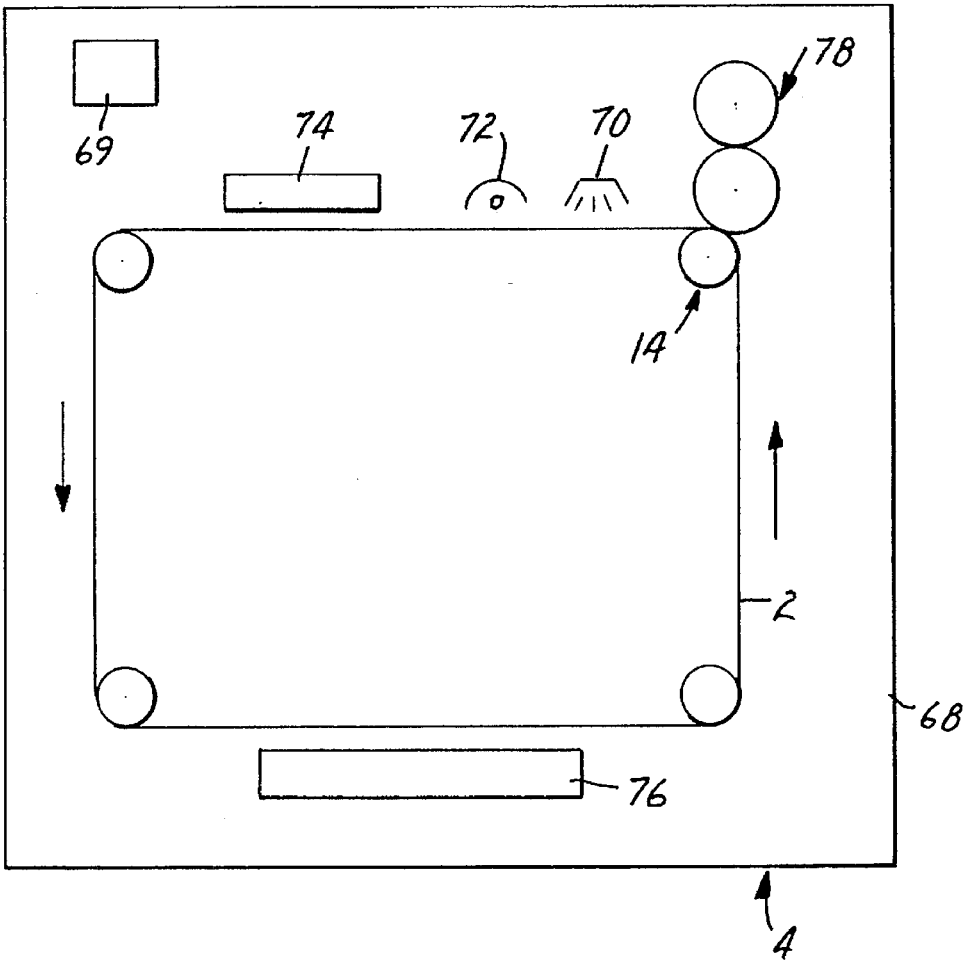
FIG. 12 is a side schematic view of an electrophotographic apparatus which includes the photoreceptive sheet.

The electrophotographic apparatus 4 is shown in FIG. 12 as also including an apparatus housing 68, a control mechanism 69, an erasure lamp 70, a charging means 72, an exposure station 74, an ink deposition mechanism or developer 76, and an ink transfer mechanism 78. The exposure station 74 includes a radiation source which projects radiation to the photoreceptive sheet 2 in an image-wise pattern corresponding to a first image to create a latent image. The first image can be extracted from a copy sheet (not shown) by the electrophotographic apparatus 4.

After the previously noted first transport mechanism 14 transports the photoreceptive sheet 2 around the transport loop, the ink deposition mechanism 76 deposits ink (not shown) onto the photoreceptive sheet 2. The ink, then, migrates on the photoreceptive sheet 2 to form a pattern that closely matches the latent image. The ink transfer mechanism 78 transfers the ink on the photoreceptive sheet 2 to a receptor, i.e., the input sheet (not shown), not unlike the transfer step when using a photoreceptive drum. A second transport mechanism (not shown) transports the input sheet to the ink transfer mechanism 78. The control mechanism 69 controls the first transport mechanism 14 and second transport mechanism, exposure station 74, ink deposition mechanism 76, and ink transfer mechanism 78.

Many other embodiments similar to those previously stated are apparent and contemplated by the inventors. A first example of another embodiment is a different transport mechanism that transports the sheet 2 in a reciprocating motion (i.e., a back-and-forth motion), rather than a circular or looping motion. The sheet cartridge 56 could still be useful with the reciprocating motion of the sheet 2.

Another embodiment could involve an electrophotographic apparatus 4 which simultaneously utilizes two or more photoreceptive sheets 2 within, for example, the transport loop, rather than a single photoreceptive sheet 2 traveling around the transport loop. A gap 52 could exist between each of the sheet ends. It is contemplated that four photoreceptive sheets 2 could be used, one for each ink color (e.g., cyan, magenta, yellow, and black).

Another embodiment could involve an electrophotographic apparatus 4 which includes a transporting mechanism similar to the paper-feeding mechanism found in computer printers and photocopiers. Typically, a paper-feeding mechanism inserts the sheet into the toner and fuser and then out of the machine. In this case, the photoreceptive sheet 10 would feed through a circular or belt like path so that it returns to the same initial position. Similar forward feed mechanisms to those found in paper path feed designs would be needed for the photoreceptive sheet pickup from a paper-like tray.

With this type of mechanism, the photoreceptive sheet 10 can be fed or pulled through its loop with precise speed control. To control the tension across the photoreceptive sheet 10, an additional mechanism can be incorporated into positions within the path where the photoreceptive sheet 10 requires tension control. Each photoreceptive sheet could be repeatedly used within the electrophotographic printer 4 until replacement is necessary. Or, at the option of the operator, the photoreceptive sheet 10 could be replaced via a software control command.

Using this paperfeed-like mechanism, a mechanism for maintaining tension within photoreceptive sheet can include drive rollers near the side edges of the photoreceptive sheet which are slightly canted to impart the cross-web (i.e., cross-sheet) tension. Another approach could include a stiffer track to keep the tension on the web. Still another approach would involve a curved photoreceptive sheet path, for example, transporting the photoreceptive sheet around shafts such that the sheet is always or is primarily flexed. Every time the path bends, even by a few degrees, it stiffens the photoreceptive sheet and prevents cross-sheet bending or buckling.

While possibly increasing the complexity of the transporting mechanism, this paperfeed-like mechanism may allow for a more simplified photoreceptive sheet cartridge. More specifically, a number of photoreceptive sheets could be stacked in a "paper tray"-like cartridge. The tray would supply the new sheet and have a compartment for the disposal of the used sheet. This would allow for inserting tens or hundreds of OPR sheets at a time into a machine and reduce operator interaction for fast, high volume print applications.

What is claimed is:

1. An apparatus adapted for use within an electrophotographic apparatus which includes the use of a toner, comprising:

radiation means for directing an image-wise pattern of radiation;

a photoreceptive sheet positioned relative to the radiation means such that the photoreceptive sheet can capture an image corresponding to the image-wise pattern, the photoreceptive sheet having a first end and a second end;

a sheet-transporting mechanism for repeatedly transporting the photoreceptive sheet through a transport path, the photoreceptive sheet having an opening therein through which toner can pass when the sheet is transported; and a toner container for containing the toner that passes through the opening.

2. The apparatus of claim 1, the transport path being a transport loop, and the photoreceptive sheet being positionable relative to the sheet-transporting mechanism such that the first end is spaced a first distance from the second end when the photoreceptive sheet is transported through the transport loop.

3. The apparatus of claim 1, the transport path being a loop having a loop distance, the photoreceptive sheet having a sheet length, and the sheet length being less than the loop distance.

4. The apparatus of claim 3, the sheet length being less than 98% of the loop distance.

5. The apparatus of claim 3, the sheet length being less than 95% of the loop distance.

6. The apparatus of claim 3, the sheet length being less than 80% of the loop distance.

7. The apparatus of claim 3, the sheet length being less than 50% of the loop distance.

8. The apparatus of claim 2, the first distance defining a gap between the first and second ends, the gap being greater than 1 centimeter.

9. The apparatus of claim 2, the first distance defining a gap between the first and second ends, the gap being greater than 5 centimeters.

10. The apparatus of claim 1, the transport path being a loop having a loop distance, the photoreceptive sheet having a sheet length, and the sheet length being at least as long as the loop distance.

11. The apparatus of claim 1, the photoreceptive sheet having a side edge, and the coupling means comprising a first surface capable of being coupled, uncoupled, and recoupled to the sheet-transporting mechanism.

12. The apparatus of claim 1, the photoreceptive sheet being transportable by the sheet-transporting mechanism without the need for a support below a substantial portion of the photoreceptive sheet.

13. The photoreceptor of claim 1, the sheet comprising a base sheet on which photoreceptive means is disposed.

14. The photoreceptor of claim 13, the photoreceptive means being a photoreceptive layer on the base sheet.

15. The apparatus of claim 1, the photoreceptive sheet having a leading edge, a portion of the leading edge being fastenable to the transporting component.

16. The apparatus of claim 1, the photoreceptive sheet having a trailing edge, and a portion of the trailing edge being fastenable to the transporting component.

17. The apparatus of claim 1, the photoreceptive sheet having a side edge, a portion of the side edge being fastenable to the transporting component.

18. The apparatus of claim 1, the sheet-transporting mechanism comprising at least one belt and a plurality of rollers, at least one of the rollers having a surface which is mateable to the belt to transport the belt, and the belt being fastenable to the photoreceptive sheet to drive the photoreceptive sheet within the electrophotographic apparatus.

19. The apparatus of claim 1, the sheet-transporting mechanism comprising a transporting component having a first center plane, the photoreceptive sheet having a second center plane, and the photoreceptive sheet being fastenable to the transporting component so that the first center plane is substantially aligned with the second center plane.

20. The apparatus of claim 18, the sheet-transporting mechanism further comprising a fastener which allows for the removal of the photoreceptive sheet from the transporting component and for the fastening of another photoreceptive sheet to the transporting component.

21. The apparatus of claim 1, further comprising a housing for enclosing the photoreceptive sheet and the sheet-transporting mechanism.

22. A photoreceptor adapted for use within an electrophotographic apparatus having a transporting mechanism for transporting the photoreceptor through a transport path, the photoreceptor comprising a flexible, polymeric-based sheet having a first end, a second end which is not attached to the first end, at least one side edge, and a photoreceptive means disposed between the first and second ends, the flexible polymeric-based sheet being transportable through the transport path without the need for a support below a substantial portion of the sheet.

23. A method for transporting a photoreceptor within an electrophotographic apparatus, comprising the steps of:

providing a photoreceptive sheet having a leading edge, a trailing edge, first and second side edges, and a sheet inner plane;

providing a transporting component moveable through a transport path, the transporting component having a component inner plane;

functionally connecting the first and second side edges of the photoreceptive sheet to the transporting component leaving the leading and trailing edges substantially unconnected to the transporting component, and substantially aligning the sheet inner plane with the component inner plane; and moving the transporting component to transport the photoreceptive sheet through the transport path.

24. The method of claim 23, the step of moving being repeatable a plurality of times.

25. The method of claim 23, the transport path being a transport loop around which the photoreceptive sheet is transported.

26. The method of claim 25, the photoreceptive sheet having a first end and a second end, the photoreceptive sheet being positionable connectable to the transporting component such that the first end is spaced a distance from the second end when the photoreceptive sheet is transported around the transport loop.

27. A method for introducing a photoreceptive sheet to and removing the photoreceptive sheet from a transporting mechanism within an electrophotographic apparatus, wherein the photoreceptive sheet has a first end and a second end, wherein the transport mechanism can transport the photoreceptive sheet in a loop, and wherein the method comprises the steps of:

providing a transporting component within the transport mechanism;

directing the photoreceptive sheet to the transporting component;

fastening the photoreceptive sheet to the transporting component so that the transporting component transports the photoreceptive sheet around the transport loop;

providing a sheet-directing component; and inserting the sheet-directing component between the first end and the second end while the photoreceptive sheet is transported around the transport loop to unfasten the photoreceptive sheet from the transporting component and to direct the photoreceptive sheet from the transporting component.

28. An apparatus adapted for use within an electrophotographic apparatus, comprising:

radiation means for directing an image-wise pattern of radiation;

a photoreceptive sheet positioned relative to the radiation means such that the photoreceptive sheet can capture an image corresponding to the image-wise pattern, the photoreceptive sheet having a first end and a second end; and a sheet-transporting mechanism for repeatedly transporting the photoreceptive sheet through a transport path, the transport path being a transport loop, the photoreceptive sheet being positionable relative to the sheet-transporting mechanism such that the first end is spaced a first distance from the second end when the photoreceptive sheet is transported through the transport loop, the first distance defining a gap between the first and second ends, the gap being sufficiently large so that a sheet guide within the electrophotographic apparatus is insertable into the gap and can direct the photoreceptive sheet from the transport loop.

29. The apparatus of claim 28, further comprising means for presenting the photoreceptive sheet to the sheet-transporting mechanism.

30. The apparatus of claim 29, further comprising a container in which at least one photoreceptive sheet is positioned before being presented to the sheet-transporting means by the presenting means.

31. The apparatus of claim 29, further comprising means for removing the photoreceptive sheet from the sheet-transporting mechanism.

32. The apparatus of claim 31, further comprising a container into which at least one photoreceptive sheet can be positioned after the photoreceptive sheet has been removed from the sheet-transporting mechanism by the removing means.

33. An apparatus adapted for use within an electrophotographic apparatus, comprising:

radiation means for directing an image-wise pattern of radiation;

a photoreceptive sheet positioned relative to the radiation means such that the photoreceptive sheet can capture an image corresponding to the image-wise pattern, the photoreceptive sheet having a first end, a second end, and a top surface; and a sheet-transporting mechanism for repeatedly transporting the photoreceptive sheet through a transport path, the sheet-transporting mechanism comprising:

at least one belt and a plurality of rollers, at least one of the rollers having a surface which is mateable to the belt to transport the belt, and the belt being fastenable to the photoreceptive sheet to drive the photoreceptive sheet within the electrophotographic apparatus; and a fastener which allows for the removal of the photoreceptive sheet from the transporting component and for the fastening of another photoreceptive sheet to the transporting component, the fastener comprising:

a first fastening surface positioned on the top surface of the photoreceptive sheet;

a fastening web having a first portion, second portion, and a bottom surface, the first portion being connected to the transporting component, and the second portion extending beyond the transporting component over the photoreceptive sheet; and a second fastening surface positioned on the bottom surface of the second portion of the fastening web, the second fastening surface being fastenable to the first fastening surface.

34. An apparatus adapted for use within an electrophotographic apparatus, comprising:

radiation means for directing an image-wise pattern of radiation;

a photoreceptive sheet positioned relative to the radiation means such that the photoreceptive sheet can capture an image corresponding to the image-wise pattern, the photoreceptive sheet having a first end, a second end, and a top surface; and a sheet-transporting mechanism for repeatedly transporting the photoreceptive sheet through a transport path, the sheet-transporting mechanism comprising:

at least one belt and a plurality of rollers, at least one of the rollers having a surface which is mateable to the belt to transport the belt, and the belt being fastenable to the photoreceptive sheet to drive the photoreceptive sheet within the electrophotographic apparatus; and a fastener which allows for the removal of the photoreceptive sheet from the transporting component and for the fastening of another photoreceptive sheet to the transporting component, the fastener comprising:

a first fastening surface positioned on the transporting component;

a fastening web having a first portion, second portion, and a bottom surface;

a second fastening surface positioned on the first portion of the fastening web, the fastening surface being fastenable to the first fastening surface; and a spacer connected to the top surface of the photoreceptive sheet near an edge of the photoreceptive sheet and connected to the bottom surface of the fastening web.

35. The apparatus of claim 34, the first and second fastening surfaces comprising microstructured fastening members.

36. An apparatus adapted for use within an imaging apparatus having radiation means for creating an image-wise pattern of radiation, the apparatus comprising:

a photoreceptive sheet for capturing an image corresponding to the image-wise pattern of radiation by being exposed to the image-wise pattern of radiation, the photoreceptive sheet having leading and trailing edges, the leading and trailing edges of the photoreceptive sheet not being attached to leading or trailing edges of another photoreceptive sheet when the photoreceptive sheet is within the imaging apparatus, the photoreceptive sheet further having a sheet inner plane; and a sheet-transporting mechanism for transporting the photoreceptive sheet through a transport path such that the sheet is positioned relative to the radiation means, the mechanism having an inner mechanism plane which is substantially aligned with the sheet inner plane when transporting the photoreceptive sheet.

37. The apparatus of claim 36, further comprising a container in which at least one photoreceptive sheet is positioned before being presented to the sheet-transporting means by the presenting means.

38. The apparatus of claim 36, further comprising:

means for removing the photoreceptive sheet from the sheet-transporting mechanism; and a container into which at least one photoreceptive sheet can be positioned after the photoreceptive sheet has been removed from the sheet-transporting mechanism by the removing means.

39. A photoreceptor adapted for use within an electrophotographic apparatus having a transporting mechanism for transporting the photoreceptor through a transport path, the photoreceptor comprising:

a sheet having a first end, a second end, a first side edge, a second side edge, a sheet inner plane, and a photoreceptive means disposed between the ends and edges;

a first side edge connector positioned adjacent to at least a portion of the first side edge for connecting the first side edge of the sheet to the transporting mechanism, the first side edge connector having a first inner plane which is substantially aligned with the sheet inner plane; and a second side edge connector positioned adjacent to at least a portion of the second side edge for connecting the second side edge of the sheet to the transporting mechanism, the second side edge connector having a second inner plane which is substantially aligned with the sheet inner plane.

40. A photoreceptor assembly adapted for use within an image-capturing apparatus having a transporting mechanism for transporting the photoreceptor through a transport path, the photoreceptor assembly comprising:

a photoreceptive sheet for capturing an image, the photoreceptive sheet having a first side edge and a sheet inner plane; and a first side edge transporting member positioned to be functionally connected to the first side edge of the photoreceptive sheet, the first edge transporting member having a first member inner plane which is substantially aligned with the sheet inner plane when the first edge transporting member is functionally connected to the first side edge transporting member.

41. The photoreceptor assembly of claim 40, the first side edge transporting member having a first member inner plane, the first side edge transporting member being positioned such that the first side edge of the sheet is aligned with the first member inner plane when the photoreceptive sheet is functionally connected to the first side edge transporting member.

42. The photoreceptor assembly of claim 40, the first member inner plane being the neutral plane of the first side edge transporting member, and the sheet inner plane being the neutral plane of the photoreceptive sheet.

43. The photoreceptor assembly of claim 40, the photoreceptive sheet having a second side edge, the photoreceptor assembly further comprising a second side edge transporting member which is positioned to be functionally connected to and aligned with the second side edge of the photoreceptive sheet.

44. The photoreceptor assembly of claim 43, the second side edge transporting member having a second member inner plane, the second side edge transporting member being positioned such that the sheet inner plane is substantially aligned with the second member inner plane when the photoreceptive sheet is functionally connected to the second side edge transporting member.

45. The photoreceptor assembly of claim 44, the second member inner plane being the neutral plane of the second side edge transporting member.

46. An imaging apparatus, comprising:

an apparatus housing;

radiation means within the apparatus housing for directing an image-wise pattern of radiation;

a photoreceptive sheet positionable within the housing, the sheet having first and second side edges and a sheet thickness within which is a sheet inner plane; and a sheet-transporting mechanism positioned within the housing and functionally connectable to the sheet to transport the sheet through a transport path, the sheet-transporting mechanism comprising:

a first side edge transporting member having a first member inner plane, the first side edge transporting member being functionally connectable to the first side edge of the sheet such that the sheet inner plane is substantially aligned with the first member inner plane; and a second side edge transporting member having a second member inner plane, the second side edge transporting member being functionally connectable to the second side edge of the sheet such that the sheet inner plane is substantially aligned with the second member inner plane.

47. The imaging apparatus of claim 46, the sheet having a sheet thickness within which is a sheet inner plane, the first side edge transporting member being functionally connectable to the first side edge of the sheet such that the sheet inner plane is aligned with the first member inner plane, and the second side edge transporting member being functionally connectable to the second side edge of the sheet such that the sheet inner plane is aligned with the second member inner plane.

48. The imaging apparatus of claim 46, the first side edge transporting member being a first belt, the second side edge transporting member being a second belt.

49. The imaging apparatus of claim 46, further comprising:

a charging means positioned within the housing adjacent to the sheet path;

a toner deposition mechanism positioned within the housing adjacent to the sheet path;

a toner transfer mechanism positioned within the housing adjacent to the sheet path; and an erasure lamp positioned within the housing adjacent to the sheet path.

50. The imaging apparatus of claim 46, the second member inner plane being the neutral plane of the second side edge transporting member and the sheet inner plane being the neutral plane of the photoreceptive sheet.

51. An apparatus adapted for use within an imaging apparatus, comprising:

radiation means for directing an image-wise pattern of radiation;

a photoreceptive sheet positioned relative to the radiation means such that the photoreceptive sheet can capture an image corresponding to the image-wise pattern, the photoreceptive sheet having a first end, a second end, and an sheet inner plane; and a sheet-transporting mechanism for transporting the photoreceptive sheet through a transport path, the sheet-transporting mechanism comprising a transporting member having a member inner plane which is substantially aligned with the sheet inner plane when the photoreceptive sheet is connected to and transported by the transporting member.

52. The apparatus of claim 51, the member inner plane being the neutral plane of the transporting member and the sheet inner plane being the neutral plane of the photoreceptive sheet.

53. A method for fastening a photoreceptive sheet to a transporting mechanism within an imaging apparatus, comprising the steps of:

providing a photoreceptive sheet having first and second side edges;

providing a transporting mechanism having a first side edge transport member and a second side edge transporting member, the first side edge transporting member having a first member inner plane and the second side edge transporting member having a second member inner plane;

fastening the first side edge of the sheet to the first side edge transporting member such that the first side edge is aligned with the first member inner plane; and fastening the second side edge of the sheet to the second side edge transporting member such that the second side edge is aligned with the second member inner plane.

* * * * *